US008631632B2

(12) United States Patent
Morales et al.

(10) Patent No.: US 8,631,632 B2
(45) Date of Patent: Jan. 21, 2014

(54) CONTAINER PRESSURIZING AND SEALING APPARATUS AND METHODS OF PRESSURIZING CONTAINERS

(75) Inventors: Jaime Jorge Morales, South Lebanon, OH (US); Bruce Alan Schauble, Liberty Township, OH (US); Charley Eugene Eberhard, Winnersh (GB); Christopher Luke Leonard, Mason, OH (US); Douglas Bruce Zeik, Liberty Township, OH (US)

(73) Assignee: The Gillette Company, Boston, MA (US)

( * ) Notice: Subject to any disclaimer, the term of this patent is extended or adjusted under 35 U.S.C. 154(b) by 281 days.

(21) Appl. No.: 13/108,247

(22) Filed: May 16, 2011

(65) Prior Publication Data

US 2012/0291404 A1 Nov. 22, 2012

(51) Int. Cl.
*B65B 3/04* (2006.01)

(52) U.S. Cl.
USPC ..... 53/470; 53/432; 53/488; 53/510; 222/402.1

(58) Field of Classification Search
USPC ..... 53/432, 470, 488, 510; 222/402.1, 394, 222/542; 413/4, 8, 7, 42, 43; 141/20, 82, 141/11, 3
See application file for complete search history.

(56) References Cited

U.S. PATENT DOCUMENTS 3,336,720 A * 8/1967 Honisch ..... 53/470
3,477,195 A 11/1969 Chambers
3,613,960 A 10/1971 Beard
3,977,151 A * 8/1976 Reever et al. ..... 53/408
4,122,978 A 10/1978 Guimond et al.
4,150,522 A * 4/1979 Burger ..... 53/470
4,233,725 A * 11/1980 Burger ..... 29/451
4,402,427 A 9/1983 Muskovin et al.
4,832,236 A * 5/1989 Greaves ..... 222/402.1
4,938,000 A * 7/1990 Smith et al. ..... 53/88
5,035,106 A * 7/1991 Haase ..... 53/470
5,181,366 A * 1/1993 Smith et al. ..... 53/470
5,226,573 A * 7/1993 Brugerolle et al. ..... 222/402.1
5,247,777 A * 9/1993 Smith et al. ..... 53/88
5,385,303 A 1/1995 Gosselin et al.
6,018,987 A * 2/2000 Mayer et al. ..... 73/49.2
6,250,505 B1 6/2001 Petit
6,401,979 B1 6/2002 Mekata et al.
6,405,898 B1 6/2002 O'Connor et al.
6,415,800 B2 7/2002 Poisson et al.

(Continued)

FOREIGN PATENT DOCUMENTS

EP 470727 A1 * 2/1992 ..... B29C 49/48

OTHER PUBLICATIONS

PCT International Search Report dated Oct. 26, 2012.

*Primary Examiner* — Hemant M Desai
(74) *Attorney, Agent, or Firm* — Jay A. Krebs

(57) ABSTRACT

A process for pressurizing a container assembly includes engaging the outer container around a neck of the outer container at a location between a shoulder of the outer container and a mouth of the outer container with a neck clamp device. The neck clamp device is used to support the outer container as the outer container moves from one location to a different location. An at least partial seal is formed about the neck of the outer container by engaging the neck clamp device with an outer bell member of a crimper-pressurized fluid fill head.

18 Claims, 6 Drawing Sheets

(56) References Cited

U.S. PATENT DOCUMENTS

| | | | | |
|---|---|---|---|---|
| 6,622,943 | B2 | 9/2003 | Poisson et al. | |
| 6,789,702 | B2 | 9/2004 | O'Connor et al. | |
| 6,874,544 | B2 | 4/2005 | O'Connor et al. | |
| 6,923,342 | B2 | 8/2005 | Bourque et al. | |
| 7,810,675 | B2 | 10/2010 | Wheatley | |
| 2007/0240387 | A1 | 10/2007 | Smith et al. | |
| 2007/0241131 | A1 | 10/2007 | Smith et al. | |
| 2007/0241132 | A1 | 10/2007 | Smith et al. | |
| 2007/0241133 | A1 | 10/2007 | Smith et al. | |
| 2007/0267437 | A1* | 11/2007 | Nimmo et al. | 222/95 |
| 2010/0252952 | A1* | 10/2010 | Pennington | 264/219 |
| 2011/0108574 | A1 | 5/2011 | Nimmo et al. | |

* cited by examiner

CONTAINER PRESSURIZING AND SEALING APPARATUS AND METHODS OF PRESSURIZING CONTAINERS

TECHNICAL FIELD

The present specification generally relates to container pressurizing and sealing apparatus and methods of pressurizing containers.

BACKGROUND

Liquid personal care products are available in a wide variety of containers, including bottles, jars, tubes, and cans. One exemplary container is an aerosol container, such as bag-in-can or bag-on-valve type container. For bag-on-valve containers, as one example, a flexible bag may be attached to an aerosol valve. Exemplary containers include those disclosed in U.S. Pat. Nos. 7,810,675, 6,923,342, 6,874,544, 6,789,702, 6,622,943, 6,415,800, 6,405,898, 6,250,505, 5,385,303, 4,402,427, 4,122,978, 3,613,960 and U.S. application Ser. Nos. 11/405,320, 11/405,288, 11/405,046 and 11/405,295.

The flexible bag may be filled with a product that is to be dispensed by the consumer. The container may be filled with a pressurized fluid between the flexible bag and inside wall of the container. When the aerosol valve is actuated, the pressurized fluid forces the product from the bag and through the aerosol valve. Due to this pressurized arrangement, the filling and sealing of the containers can be difficult to achieve without specialized equipment.

SUMMARY

In one embodiment, a process for pressurizing a container assembly includes locating a valve assembly at a mouth of an outer container. The outer container is engaged around a neck of the outer container at a location between a shoulder of the outer container and a mouth of the outer container with a neck clamp device. The neck clamp device is used to support the outer container as the outer container moves from one location to a different location. An at least partial seal is formed about the neck of the outer container at a location remote from the shoulder of the outer container using an outer bell member of a crimper-pressurized fluid fill head. A pressurized fluid is introduced into the outer container. A fluid-tight seal is formed between the valve assembly and the outer container.

In another embodiment, a process for pressurizing a container assembly includes engaging the outer container around a neck of the outer container at a location between a shoulder of the outer container and a mouth of the outer container with a neck clamp device. The neck clamp device is used to support the outer container as the outer container moves from one location to a different location. An at least partial seal is formed about the neck of the outer container by engaging the neck clamp device with an outer bell member of a crimper-pressurized fluid fill head.

In another embodiment, a container pressurizing and sealing system includes a neck clamp device that engages an outer container around a neck of the outer container at a location between a shoulder of the outer container and a mouth of the outer container. The neck clamp device supports the outer container as the outer container moves from one location to a different location. A crimper-pressurized fluid fill head includes an outer bell member that engages the neck clamp device and forms an at least partial seal about the neck of the outer container.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to container pressurizing and sealing apparatus and methods of pressurizing containers that utilize a neck handling clamp that provides a sealing surface for creating a seal about a neck of the container at a location remote from a shoulder region of the container. Once the seal is formed, the container may be pressurized and a valve assembly may be sealed to the container thereby forming an air-tight seal.

Figure 1:
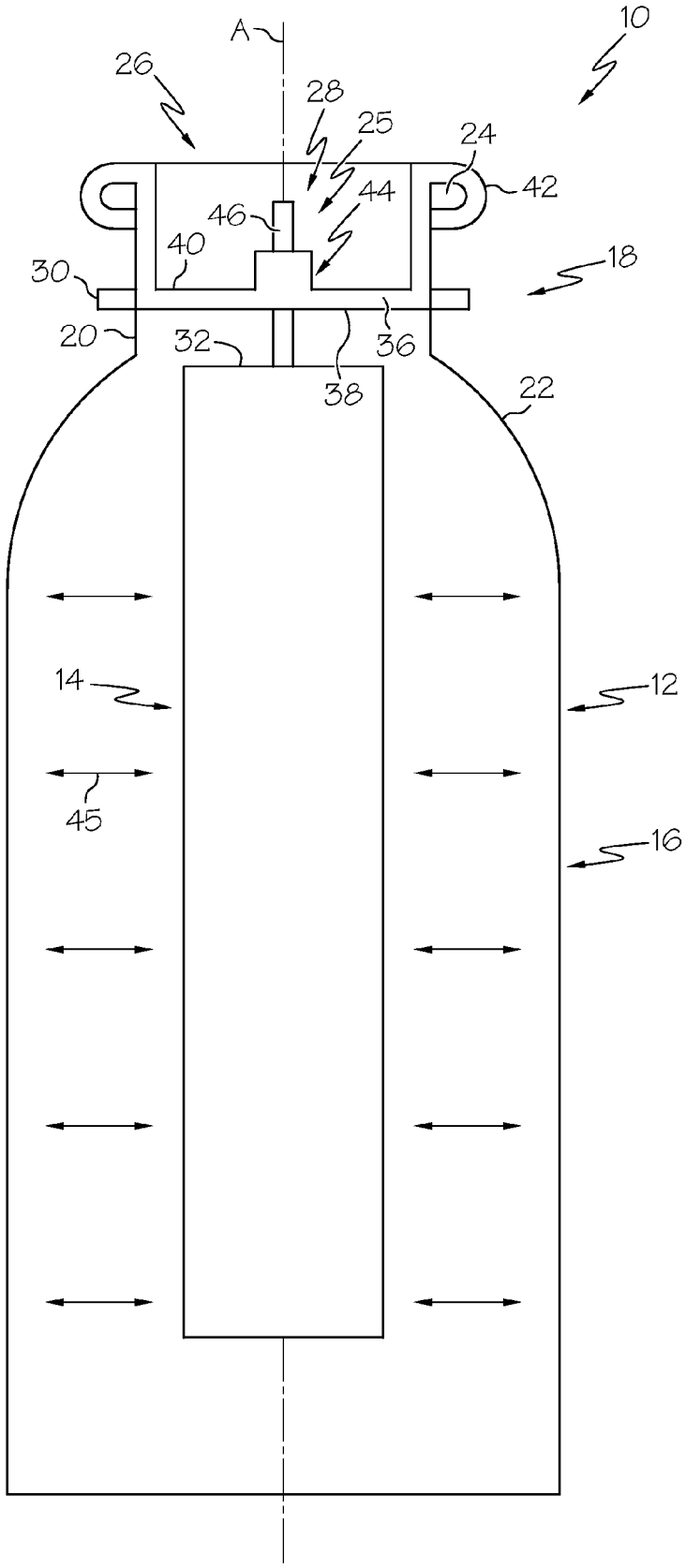
FIG. 1 is a diagrammatic, side section view of an embodiment of a pressurized container assembly.

Referring to FIG. 1, an exemplary pressurized container assembly 10 includes an outer container 12 and an inner container 14 disposed within the outer container 12. The outer container 12 may include a body portion 16 and a top portion 18 that extends upwardly from the body portion 16. The top portion 18 includes a neck 20 that extends upwardly from a shoulder 22 of the body portion 16 to a mouth 25. The shoulder 22 extends inwardly toward a central axis A of the outer container 12 to provide a narrowing transition between the larger width dimension of the body portion 16 and the narrower width dimension of the neck 20. An upper lip flange 24 is provided about an upper opening 26 of the outer container 12. As will be described in greater detail below, the upper lip flange 24 may provide connection structure for connecting a valve assembly 28 to the outer container 12.

A neck ring 30 may extend about the periphery of the neck 20. The neck ring may have a continuous shelf-like surface that extends continuously about the entire periphery of the neck 20. The neck ring may be round, circular, polygonal or any other suitable shape.

The outer container 12 may be rigid. By rigid, it is meant that the outer container 12 does not substantially change shape or size in response to normal usage forces or depletion of the contents of the pressurized container assembly 10. A rigid outer container 12 may allow the pressurized container assembly 10 to be conveniently shipped, stored, displayed, placed on a tabletop, etc. Furthermore, a rigid outer container 12 can provide protection in the event that the pressurized container assembly 10 is dropped, or otherwise disturbed. In other embodiments, the outer container may not be formed by a rigid material. For example, the outer container 12 may become more and more flexible as the contents of the pressurized container assembly 10 are depleted. Suitable materials for the outer container 12 may include metals, plastics, glass and combinations thereof of any wall thickness suitable for the intended pressurization.

The inner container 14 may generally be formed of a material more flexible than the outer container 12 and includes an end 32 that is connected to the valve assembly 28. The inner container 14 may be connected to the valve assembly 28 so that a product located in the inner container 14 can be dispensed through the valve assembly 28, when the valve assembly 28 is actuated. In other embodiments, the inner container 14 may not be connected to the valve assembly 28 and placed within the outer container 12. For example, the product and the pressurized fluid may not be separated by an inner bag within the outer container 12. In alternative embodiments, the valve assembly 28 may be connected to a dip tube rather than an inner container 14. In other embodiments, the valve assembly 28 may not include a dip tube or inner bag.

The exemplary valve assembly 28 includes a valve cup 36 having a cup bottom 38, a cup top 40 and a cup flange 42 extending around a periphery of the cup top 40. The valve assembly 28 includes a valve 44 and a valve stem 46 extending therefrom. A gasket (not shown) may be optionally provided with the cup flange 42 to aid in forming a seal between the valve assembly 28 and the outer container 12. As can be seen, the cup flange 42 is crimped around the upper lip flange 24 of the outer container 12. As used herein, the term "crimping" broadly refers to providing a permanent connection of one structural member to another structural member. This crimping can result in a permanent deformation of the cup flange and can result in the permanent connection to the upper lip flange 24 to form the fluid or vapor-tight seal between the valve assembly 28 and the outer container 12. The valve cup 36 may be formed of any suitable material such as metals and thermoplastics. One suitable metal for forming the valve cup 36 includes steel.

The valve assembly 28 can be inserted into or outside of the neck 20 of the outer container 12. While crimping is described above, the valve assembly 28 may be joined to the container neck 20 in any suitable fluid tight or vapor tight manner, sufficient to withstand internal (represented by arrows 45) or external pressurization of the pressurized container assembly 10. A press fit, interference fit, clearance fit may be utilized for joining the neck 20 and valve assembly 28. Joining may also be accomplished by friction welding, solvent welding, high frequency welding, adhesive, or a combination thereof. If desired, an intermediate material or component may be disposed between the valve assembly 28 and neck 20, so long as such material or component provides an adequate seal.

Figure 3:
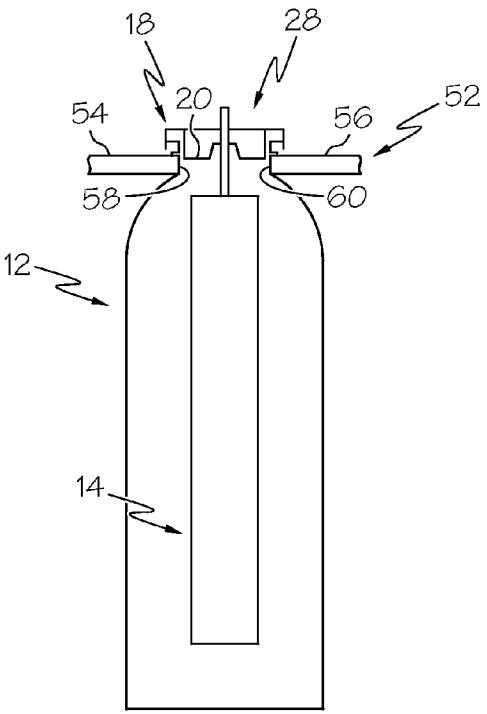
FIG. 3 is a diagrammatic, side section view of the outer container of FIG. 2 at a valve insert station for receiving a cup valve assembly.
Figure 2:
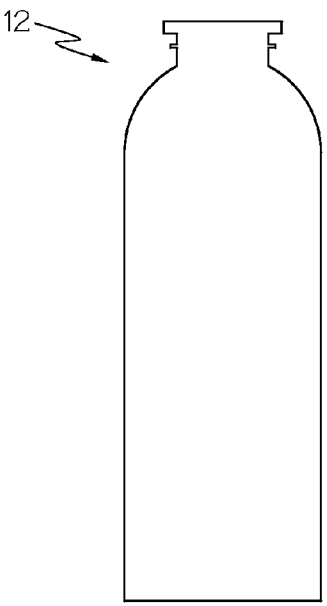
FIG. 2 is a diagrammatic, side section view of an embodiment of an outer container of the pressurized container assembly of FIG. 1.

Referring now to FIGS. 2-7 an exemplary undercup process for pressurizing the pressurized container assembly 10 and connecting the valve assembly 28 to the outer container 12 is illustrated. Referring first to FIG. 2, the outer container 12 moves toward a valve insert station (FIG. 3), for example, using a conveyor, star wheel, infeed worm and/or the like. As shown in FIG. 3, a neck clamp device 52 includes a pair of opposed jaws 54 and 56 each having a semi-circular recess 58 and 60 having a shape conforming to the exterior surface of the neck 20. In some embodiments, the opposed jaws 54 and 56 have a thickness that is sized to fit between the neck ring 30 and the shoulder 22 to support the outer container 12 in the illustrated upright, standing orientation. A drive (not illustrated) may be provided for moving the jaws 54 and 56 between an open position where the jaws 54 and 56 are disengaged from the outer container 12 and a closed position shown in FIG. 3 where the jaws 54 and 56 are moved into engagement with the outer container 12 and orient and support the outer container 12 in a desired proper location for completion of the pressurizing operation.

At the valve insert station, the valve assembly 28 including the valve cup 36 is loosely placed on the top portion 18 of the outer container 12 such that the cup flange 42 seats against the lip flange 24. As can be seen by FIG. 3, the inner container 14 may be preassembled to the valve assembly 28 and placed within the outer container 12 as the valve assembly 28 is loosely placed on the top portion 18 of the outer container 12. In some embodiments, the inner container 14 may be prefilled with a product prior to its placement within the outer container 12. In other embodiments, the inner container 14 may be filled after its placement within the outer container 12. The type and nature of products capable of being contained by and dispensed from the inner container 14 are unlimited. Exemplary products include shaving compositions, antiperspirants, deodorants, cleansers, hair care compositions, skin care compositions, and foods. Other products are equally contemplated herein. Shaving compositions is one product type that is suitable and can take various forms, including, for example, aerosol foams, and self-foaming lotions or gels.

Figure 4:
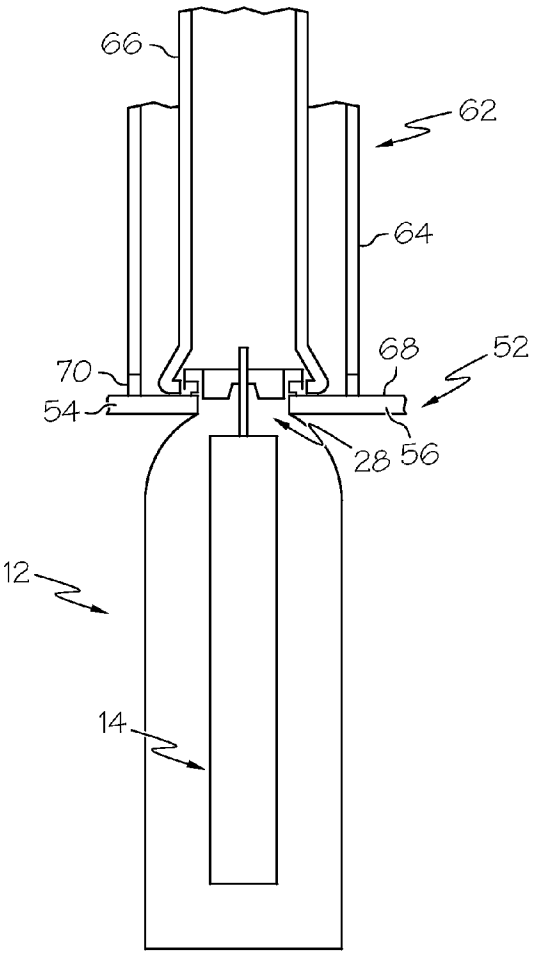
FIG. 4 is a diagrammatic, side section view of the outer container and cup valve subassembly at a crimping and pressurization location using a crimper-pressurized fluid head.

Referring to FIG. 4, once the valve assembly 28 with the inner container 14 operatively connected thereto is loosely placed on the top portion 18 of the outer container 12, the outer container 12 and valve assembly 28 is moved to a crimper-pressurized fluid fill head 62. In some embodiments, the neck clamp device 52 remains engaged with the outer container 12 to support the subassembly as it moves from location to location. The crimper-pressurized fluid fill head 62 generally includes an outer bell member 64 and a crimping member 66 disposed within the outer bell member 64.

Figure 4A:
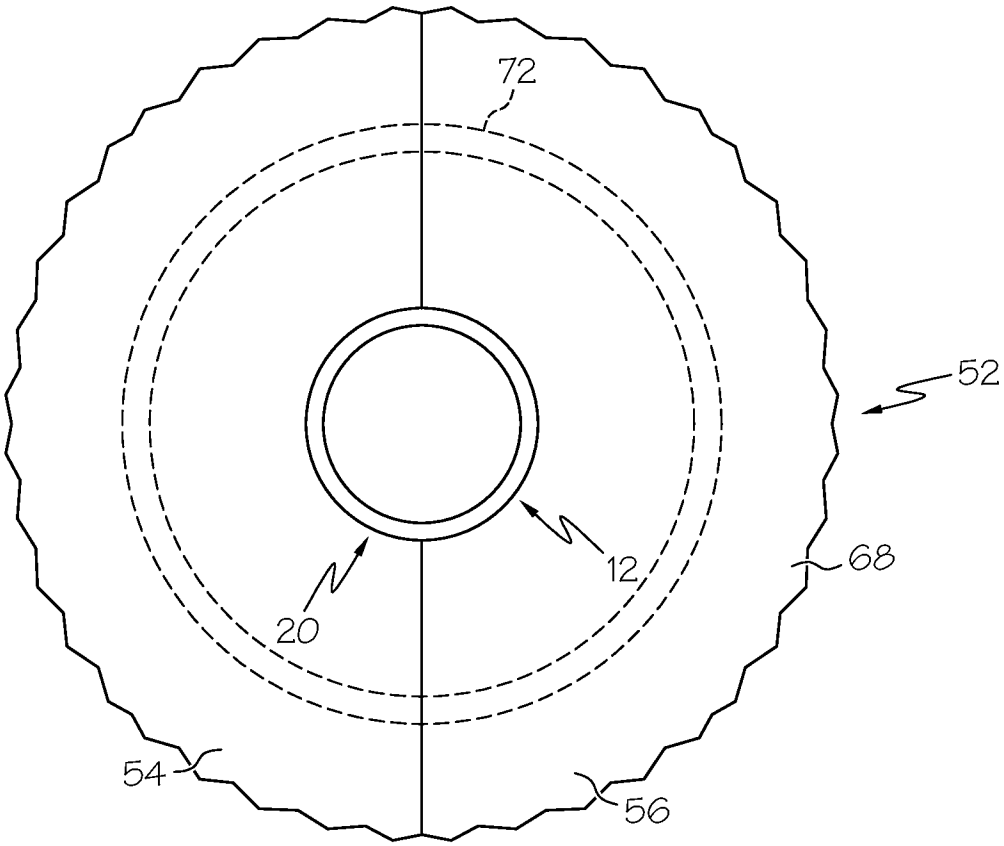
FIG. 4A is a top view of the outer container engaged with an embodiment of a neck clamp device in a closed configuration.
Figure 4B:
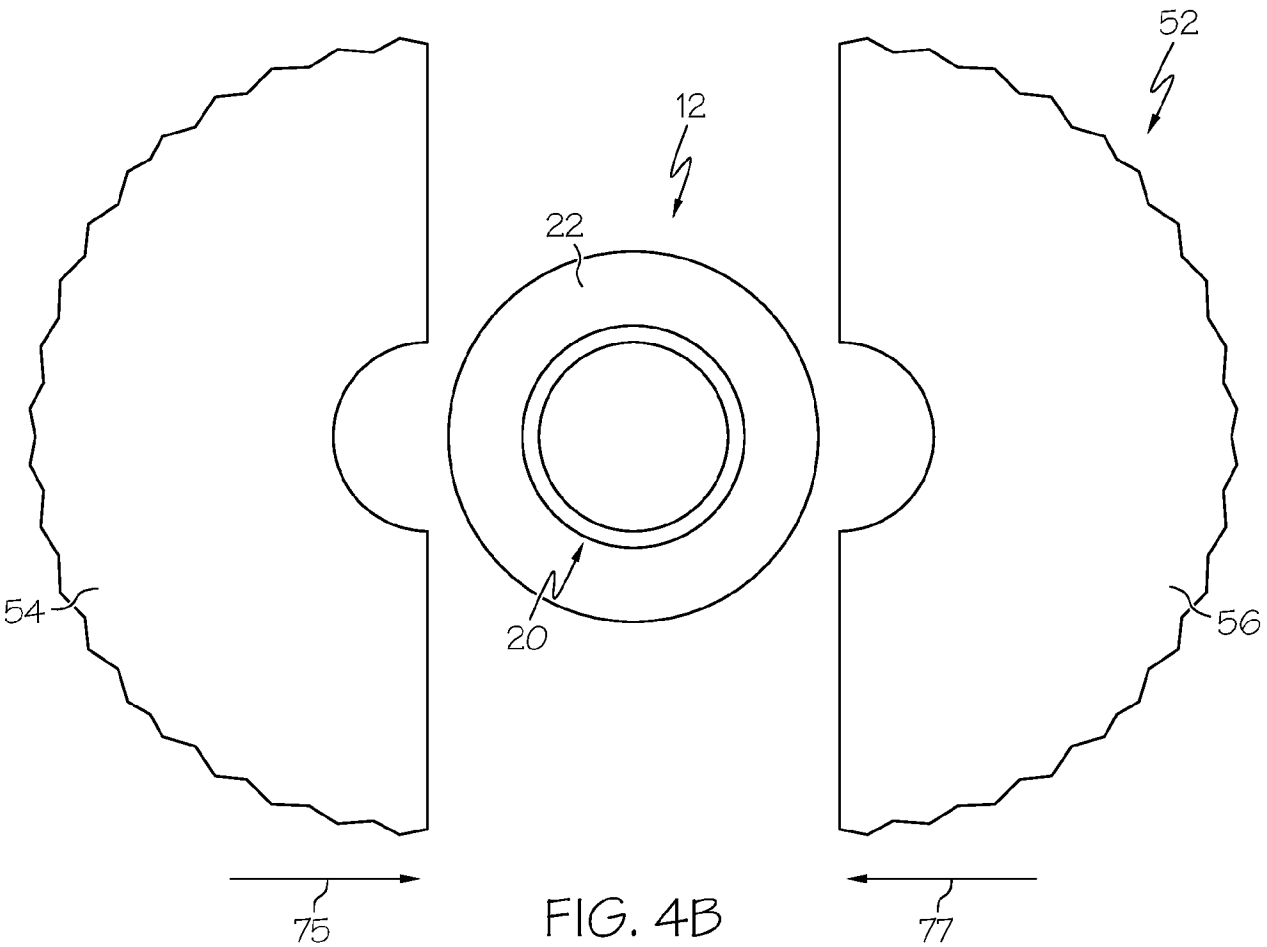
FIG. 4B is a top view of the outer container with the neck clamp device of FIG. 4A in an open configuration.

As shown by FIG. 4, the outer bell member 64 of the crimper-pressurized fluid fill head 62 is lowered onto an upper sealing surface 68 of the neck clamp device 52 so as to form an at least partial seal about the neck 20 of the outer container 12. The term "partial seal" refers to a seal that may not be vapor or fluid-tight, but is sufficient for pressurizing the outer container 12 to the desired pressure. In some embodiments, a gasket 70 may be provided to aid in forming the seal between the outer bell member 64 and the upper sealing surface 68 of the neck clamp device 52. Referring briefly to FIG. 4A, this seal is represented by region 72 that extends continuously about the neck 20 over each jaw 54 and 56 at a location remote from any surface of the outer container 12, such as the shoulder 22, neck 20, neck ring 30 and upper lip flange 24 (FIG. 1). FIG. 4B illustrates the neck clamp device 52 in an open configuration, prior to engagement with the outer container 12. Any suitable drive mechanism (e.g., a hydraulic or pneumatic actuator, motor, etc.) may be used to open and close (see arrows 75 and 77) the neck clamp device 52. While the jaws 54 and 56 are illustrated moving in a lateral and radial direction, they may move in other directions such as diagonal and/or rotational. Such a sealing arrangement moves the compression forces required to provide the seal away from any portion of the outer container 12 and to the neck clamp device 52.

While two jaws 54 and 56 each subtending 180 degrees is shown in FIGS. 4A and 4B, any other suitable neck clamp device arrangement may be utilized. For example, three jaws each subtending 120 degrees, four jaws each subtending 90 degrees and the like may be used.

Figure 5:
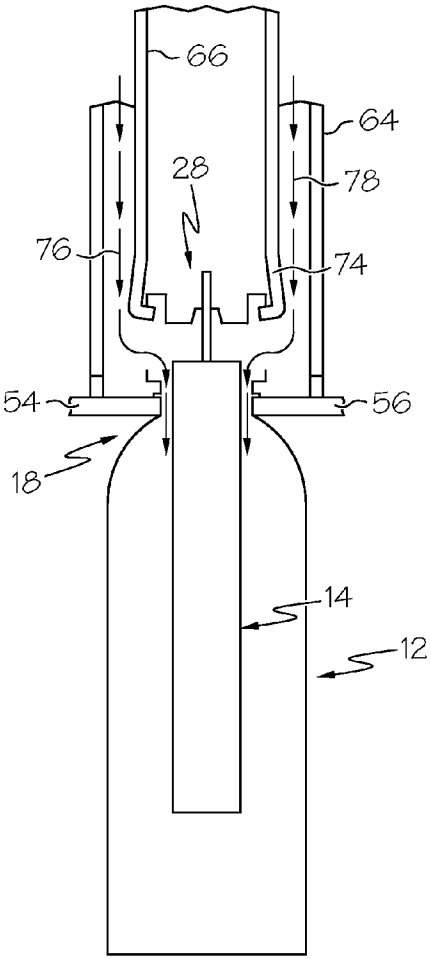
FIG. 5 is another diagrammatic, side section view of the outer container and cup valve subassembly at a crimping and pressurization location using a crimper-pressurized fluid head.

Referring to FIG. 5, the crimping member 66 may include a collet 74 that grips the valve assembly 28 and lifts the valve assembly 28 away from the top portion 18 of the outer container 12. In some embodiments, a vacuum may be used to lift the valve assembly 28 and/or a vacuum may applied through the outer bell member 64 so as to remove residual air and unwanted materials or vapors from within the outer bell member 64 and the outer container 12. As represented by arrows 76 and 78 of FIG. 5, a pressurized fluid is introduced underneath the valve assembly 28 and into the outer container 12. Suitable pressurized fluids include compressed gases (e.g. nitrogen, air, etc.) and/or compressed liquids (e.g., liquefied hydrocarbons).

Figure 6:
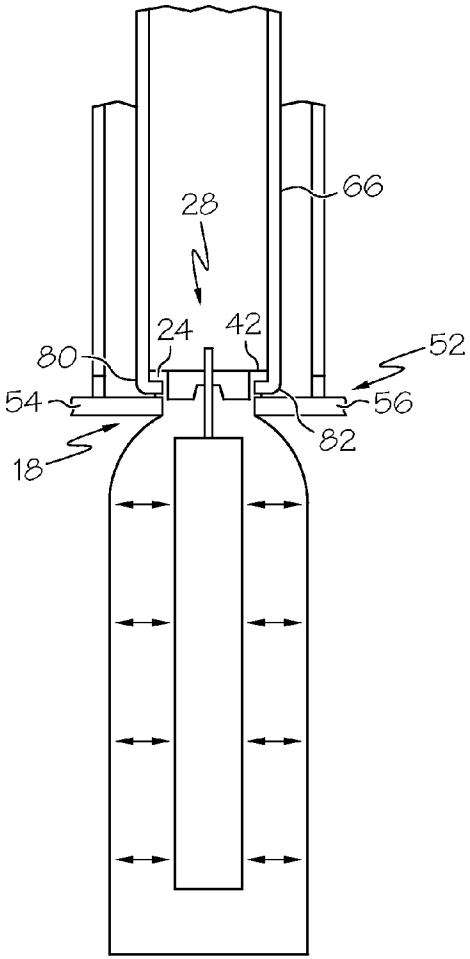
FIG. 6 is another diagrammatic, side section view of the outer container and cup valve subassembly at a crimping and pressurization location using a crimper-pressurized fluid head.
Figure 7:
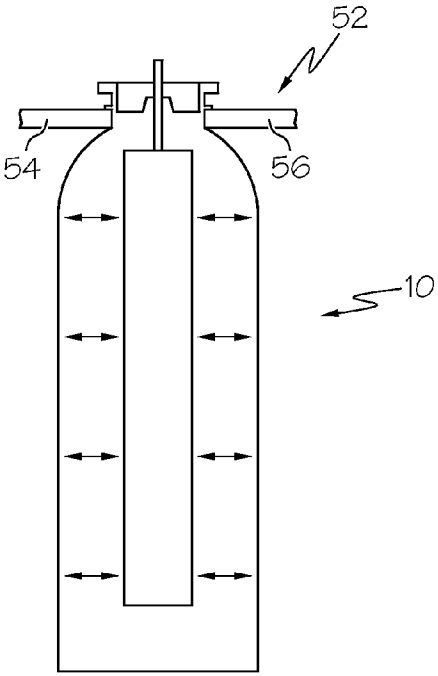
FIG. 7 is a diagrammatic, side section view of the pressurized container assembly after the crimping and pressurization process.

Referring to FIG. 6, after the charge of pressurized fluid is introduced, the crimping member 66 lowers the valve assembly 28 onto the top portion 18 such that the cup flange 42 seats against the lip flange 24. Further downward movement of the crimping member 66 can begin to plastically deform the cup flange 42 against the lip flange 24. In some embodiments, an actuating plunger or some other actuator and/or structure may cause bottom ends of collet segments 80 and 82 to move inwardly to crimp the cup flange 42 beneath the lip flange 24 thereby sealing the valve assembly 28 to the outer container 12. In other embodiments, vacuum or air pressure may be used to clinch the valve assembly 28 to the outer container 12. Referring to FIG. 7, the crimper-pressurized fluid fill head 62 may then lift from the neck clamp device 52 and the pressurized container assembly 10. The pressurized container assembly 10 may then be conveyed or otherwise moved away from the crimper-pressurized fluid fill head 62. In some embodiments, the neck clamp device 52 may continue to support the pressurized container assembly 10 after the undercup pressurizing process.

Figure 8:
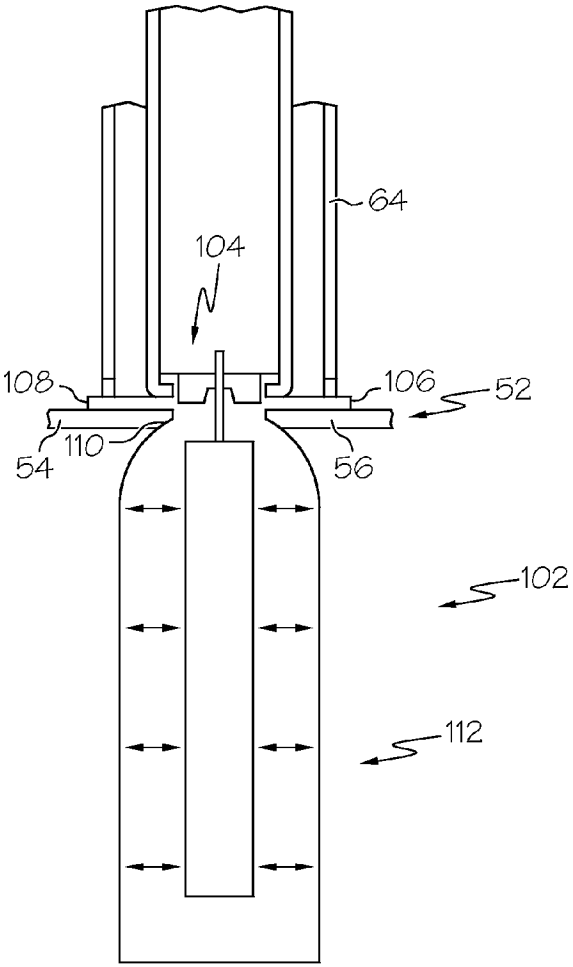
FIG. 8 is a diagrammatic, side section view of another embodiment of an outer container at a crimping and pressurization location using a crimper-pressurized fluid head.

Referring to FIG. 8, another embodiment of an undercup process for pressurizing a pressurized container assembly 102 and connecting a valve assembly 104 is similar to that described above with regard to FIGS. 2-7. In the embodiment of FIG. 8, a neck ring 106 is sized (e.g., in diameter) to allow the outer bell member 64 of the crimper-pressurized fluid fill head 62 to engage an upper sealing surface 108 of the neck ring 106 at a location spaced from a shoulder 110 of the outer container 112. The size of the neck ring 106 is exaggerated for illustrative purposes. The neck ring 106 may further be supported by the neck clamp device 52 with jaws 54 and 56 during the undercup process. In some embodiments, there may be no neck ring. Instead, the neck clamp device may support the container beneath the upper lip flange.

It should be noted that while the outer bell member is described above forming an at least partial seal by engaging a neck clamp device and/or a neck ring, the outer bell member may engage other sealing surfaces to form the at least partial seal about the neck of the outer container at a location remote from the shoulder of the outer container. For example, the outer bell member may engage any other suitable support surface for the outer container that supports the outer container in an upright position.

It should also be noted that the neck clamp device may be used to engage an outer container as described above without any pressurization operation. For example, a neck clamp device may be used during a crimping operation where a crimping member plastically deforms a valve assembly to an outer container without first pressurizing the outer container. The neck clamp device can support the neck of the outer container as the crimping member applies downward pressure against the outer container, which can improve crimping precision.

The above-described container assemblies may be referred to as a bag-on-valve type container. Various other container types may include: manually activated air pump spray devices in which a pump system is integrated into the container to allow the user to pressurize the container with air in order to expel the product; piston barrier systems in which the product is separated from the driving means by a tight-fitting piston which seals to the side of the container and may be driven by a spring under tension, by a vacuum on the product side of the piston, by finger pressure, by gas pressure to the piston, or by a variety of other means known to the packaging industry; and bag-in-can (SEPRO) systems in which the product is contained in a flexible bag within a can, with a suitable pressurized fluid injected into the space between the can and the flexible bag. Protection of the composition from oxidation and heavy metal contamination may be desired. This can be achieved, for example, by purging the composition and container with nitrogen to remove oxygen and by utilizing inert containers (e.g., plastic bottles or bags, aluminum cans or polymer coated or lined cans).

The above described undercup processes and pressurized container assemblies can allow for continuous neck handling throughout the undercup process (e.g., from initial valve assembly locating through pressurization and crimping of the valve assembly to the outer container). Furthermore, in some embodiments, there may be no need for a change of parts for different shaped bottles, particularly if the neck diameters are substantially the same. The sealing force is moved away from the body (e.g., shoulder) of the outer containers. This can allow thinner materials (or less rigid materials) to be used in forming the outer containers. This can also allow for use of smaller dimensioned outer containers (e.g., smaller diameter bodies) to undergo the undercup pressurization processes.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for pressurizing a container assembly, comprising:

locating a valve assembly at a mouth of an outer container;

engaging the outer container around a neck of the outer container at a location between a shoulder of the outer container and a mouth of the outer container with a neck clamp device, the neck clamp device used to support the outer container as the outer container moves from one location to a different location;

forming an at least partial seal about the neck of the outer container at a location remote from the shoulder of the outer container using an outer bell member of a crimper-pressurized fluid fill head, wherein the at least partial seal is formed by engaging the outer bell member with the neck clamp device;

introducing a pressurized fluid into the outer container; and forming a fluid-tight seal between the valve assembly and the outer container.

2. The process of claim 1, wherein the pressurized fluid is introduced into the outer container between the mouth of the outer container and the valve assembly.

3. The process of claim 1 comprising crimping the valve assembly onto a lip flange of the outer container to form the fluid-tight seal between the valve assembly and the outer container.

4. The process of claim 3, wherein crimping the valve assembly onto the lip flange using a collet.

5. The process of claim 4, wherein the collet is part of the crimper-pressurized fluid fill head.

6. The process of claim 1, wherein the neck clamp device includes closeable jaws that together form a sealing surface about the neck of the outer container, the outer bell member engaging the jaws such that the at least partial seal about the neck of the outer container extends along the jaws.

7. The process of claim 1 further comprising connecting the valve assembly to an inner container.

8. The process of claim 7, wherein the valve assembly comprises an aerosol valve.

9. A process for pressurizing a container assembly, comprising:

engaging the outer container around a neck of the outer container at a location between a shoulder of the outer container and a mouth of the outer container with a neck clamp device, the neck clamp device used to support the outer container as the outer container moves from one location to a different location; and forming an at least partial seal about the neck of the outer container by engaging the neck clamp device with an outer bell member of a crimper-pressurized fluid fill head.

10. The process of claim 9 further comprising:

locating a valve assembly at a mouth of an outer container; and forming a fluid-tight seal between the valve assembly and the outer container.

11. The process of claim 10 further comprising, prior to forming the fluid-tight seal between the valve assembly and the outer container, introducing a pressurized fluid into the outer container between the mouth of the outer container and the valve assembly with the outer bell member engaging the neck clamp device.

12. The process of claim 9 further comprising forming the outer container of plastic.

13. The process of claim 9, wherein the neck clamp device includes closeable jaws that together form a sealing surface about the neck of the outer container, the outer bell member engaging the jaws such that the at least partial seal about the neck of the outer container extends along the jaws.

14. The process of claim 9, wherein the neck clamp device engages the neck of the outer container between the shoulder and a neck ring of the outer container.

15. A container pressurizing and sealing system, comprising:

a neck clamp device that engages an outer container around a neck of the outer container at a location between a shoulder of the outer container and a mouth of the outer container, the neck clamp device supports the outer container as the outer container moves from one location to a different location; and a crimper-pressurized fluid fill head that includes an outer bell member that engages the neck clamp device and forms an at least partial seal about the neck of the outer container.

16. The container pressurizing and sealing system of claim 15 further comprising a crimping member moveably disposed within the outer bell member.

17. The container pressurizing and sealing system of claim 16, wherein the crimping member comprises a collet that crimps a valve assembly onto a lip flange of the outer container with the outer bell member engaging the neck clamp device and forming the at least partial seal about the neck of the outer container.

18. The container pressurizing and sealing system of claim 15, wherein the neck clamp device includes closeable jaws that together form a sealing surface about the neck of the outer container, the outer bell member engaging the jaws such that the at least partial seal about the neck of the outer container extends along the jaws.

* * * * *